US007481655B2

(12) United States Patent
Horst et al.

(10) Patent No.: US 7,481,655 B2
(45) Date of Patent: Jan. 27, 2009

(54) ROTARY JOINT

(75) Inventors: Sheldon Lynn Horst, Columbia, PA (US); Valentino Girolamo, Spencerport, NY (US)

(73) Assignee: Tyco Electronics Corporation, Middletown, PA (US)

( * ) Notice: Subject to any disclaimer, the term of this patent is extended or adjusted under 35 U.S.C. 154(b) by 26 days.

(21) Appl. No.: 11/537,779

(22) Filed: Oct. 2, 2006

(65) Prior Publication Data

US 2008/0081488 A1 Apr. 3, 2008

(51) Int. Cl.
*H01R 39/00* (2006.01)

(52) U.S. Cl. ..... 439/24; 439/26

(58) Field of Classification Search ..... 439/23, 439/24, 25, 26
See application file for complete search history.

(56) References Cited

U.S. PATENT DOCUMENTS

| | | | | |
|---|---|---|---|---|
| 2,696,570 | A * | 12/1954 | Pandapas | 310/232 |
| 2,931,999 | A * | 4/1960 | Lemmerman | 439/26 |
| 2,967,283 | A | 1/1961 | Medney | |
| 3,014,193 | A | 12/1961 | Schiller | |
| 3,126,596 | A | 3/1964 | Rector | |
| 3,185,951 | A * | 5/1965 | Le Beau | 439/26 |
| 3,219,557 | A | 11/1965 | Quintana | |
| 3,398,387 | A * | 8/1968 | Wendell | 439/26 |
| 3,509,512 | A | 4/1970 | Rizzolo | |
| 3,686,514 | A | 8/1972 | Dube et al. | |
| 4,568,847 | A | 2/1986 | Schmider | |
| 5,923,114 | A | 7/1999 | Senni | |
| 6,089,875 | A * | 7/2000 | Iwata et al. | 439/26 |
| 6,180,873 | B1 | 1/2001 | Bitko | |
| 6,561,813 | B2 | 5/2003 | Rutten et al. | |
| 2004/0074045 | A1 | 4/2004 | Winstead et al. | |
| 2004/0077199 | A1 | 4/2004 | Winstead et al. | |

FOREIGN PATENT DOCUMENTS

| | | |
|---|---|---|
| EP | 0 809 334 | 11/1997 |
| GB | 2 354 372 | 3/2001 |

OTHER PUBLICATIONS

Moog Components Group, H Series Miniature Slip Rings, Oct. 2005, 2 pages.

Air Precision, Contact Electrique Tournant T13SD Slip Ring Assembly, 2 pages, undated.

Airflyte Electronics Company, Slip Ring Assemblies, dated Oct. 24, 1994, 2 pages.

(Continued)

*Primary Examiner*—Thanh-Tam T Le

(57) ABSTRACT

A rotary joint and a method for making a rotary joint are disclosed. The rotary joint includes a cylindrical core having an external surface including at least two circumferentially oriented groove regions and a partition region intermediate the groove regions. At least a portion of the surface of a groove region is electrically conductive and at least a portion of the surface of the partition region is electrically insulating. A method for making the rotary joint includes molding the cylindrical core from a plateable resin and molding over at least some of the plateable resin with a non-plateable resin. A conductive material is plated over the plateable resin to form a rotary joint of unitary structure, eliminating the numerous components and assembly steps associated with conventional rotary joints.

17 Claims, 9 Drawing Sheets

OTHER PUBLICATIONS

Techtron Corporation, Techtron Corporation Manufacturer of Commercial Slip Ring Applications in Naples, Florida, 2 pages, downloaded from Website Aug. 18, 2006.

Moog Components Group, Slip Ring Capsules (Compact) AC6023 Compact In Various Circuit Configurations, undated, pp. 34 and 35.

Meridian Laboratory, Model MM Micro-Miniature Rotocon, dated 1998, 3 pages.

International Search Report; PCT/US2007/020767, mailed Apr. 17, 2008.

* cited by examiner

ROTARY JOINT

FIELD OF THE INVENTION

The present invention is generally directed to electrical connectors and more particularly is directed to a rotary joint.

BACKGROUND OF THE INVENTION

Rotary joints, also widely referred to as slip rings, are employed in many technical fields for connecting devices in which electrical signals and/or electrical power is transmitted from a stationary electrical unit to a rotating or rotatable electrical unit. For example, slip rings are employed for the operation of remote-controlled cameras, in which electrical communications, such as electrical power and signals for operating drive mechanisms for zoom regulation or pivoting are transmitted from one location to another via the slip ring. Slip rings are used with various other electrical devices, as well, such as rotatable searchlights, laser installations, and robotic components.

Conventional slip rings are made from a non-conductive mandrel over which individual conductive rings are slipped and then electrically isolated from one another, such as by slipping rubber washers or another non-conductive ring between adjacent conductive rings. Thus, many different components are needed to assemble even a relatively simple slip ring. These conventional slip rings require intricate and time-consuming steps of assembling multiple, isolated, conductive contact rings over a non-conductive mandrel to support the contact rings, and then introducing individual conductors running from the isolated contact rings to an external connection point. As the number of circuits increase, so does the number of additional components making up the assembly. In addition to consuming more raw materials, this undesirably increases the number of steps and time to assemble the slip ring, resulting in higher overall manufacturing costs.

These and other drawbacks are found in current slip rings.

What is needed is a rotary joint that has fewer individual component parts to simplify the manufacturing process and which may thereby reduce manufacturing costs.

SUMMARY OF THE INVENTION

According to an exemplary embodiment of the invention, a rotary joint is disclosed. The rotary joint comprises a cylindrical core having an external surface including at least two circumferentially oriented groove regions integral the core and an integral partition region intermediate the groove regions. At least a portion of the surface of a groove region is an electrically conductive portion of an electrically conductive path passing internally through the cylindrical core from the groove region to a connection point external the cylindrical core and at least a portion of the surface of the partition region is electrically insulating.

According to another exemplary embodiment of the invention, a method for making a rotary joint comprises molding a cylindrical core of a plateable resin material, molding a non-plateable resin material over at least a portion of the plateable resin material, exposing at least one surface of the plateable resin material and plating an electrically conductive material to at least a portion of the exposed surface of the plateable resin material.

One advantage of the invention is that the rotary joint may be made as a single unitary structure, eliminating the need to add individual conductive ring components over a mandrel, as well as eliminating other traditional assembly steps and associated costs in conventional slip rings.

Another advantage of the invention is that the rotary joint is geometrically arranged to have integral electrically conductive and non-conductive surfaces, in which the conductive surfaces provide multiple isolated contact rings that may be individually connected to corresponding external connection points via separate passageways within the rotary joint.

Yet another advantage of the invention is that the rotary joint can be manufactured by directly molding the features of the rotary joint with plateable and non-plateable resins, followed by plating the plateable resin with a conductive material to produce electrically conductive pathways across various three dimensional surfaces of the rotary joint.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Exemplary embodiments relate to a three dimensional rotary joint comprising electrically conductive and non-conductive surfaces arranged with respect to one another to provide multiple electrically isolated circuits. According to one embodiment of the invention, the rotary joint comprises plateable and non-plateable resins arranged to provide both plateable and non-plateable surfaces of the rotary joint. By "plateable" and "non-plateable" is meant that the resin generally accepts or does not accept, respectively, plating of an electrically conductive material on its surface. The exposed plateable surfaces attract and adhere to electrically conductive materials, such as metals, to create the electrically conductive surface and thus provides a resin based connector with conductive pathways across various three dimensional surfaces of the rotary joint. The plateable surfaces thus permit creation of circuit trace paths on both external and internal surfaces of the rotary joint that are electrically isolated from other paths by a non-plateable resin to which no electrically conductive material adheres during plating and provides a surface that remains electrically insulating.

In this manner, connectors in accordance with exemplary embodiments of the invention are formed with a geometric arrangement of conductive and non-conductive surfaces that effectively accomplish, preferably in a unitary structure, what other connectors, such as conventional slip rings, accomplish through intricate and time consuming assembly of many separate components.

Figure 1:
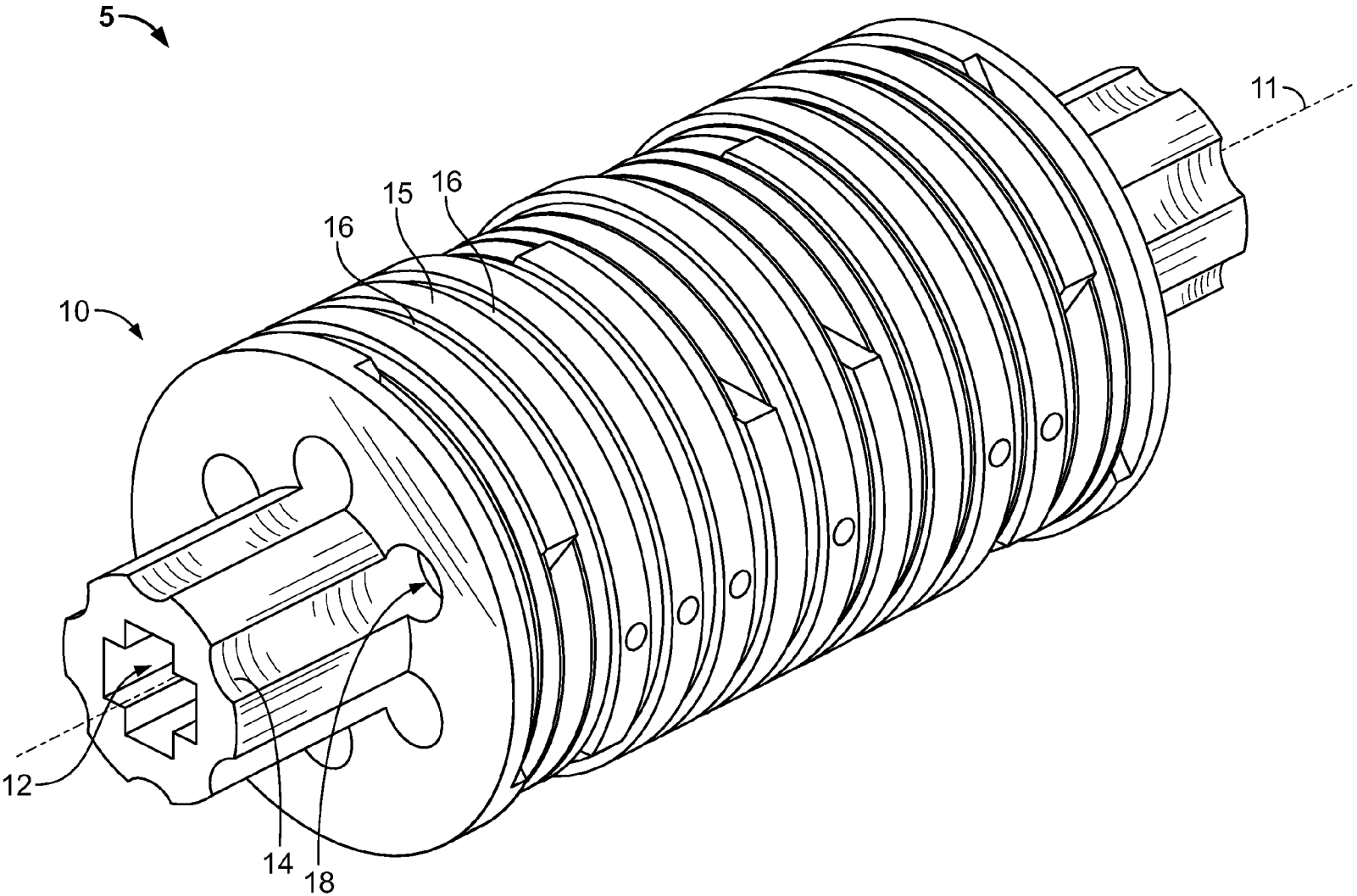
FIG. 1 illustrates an isometric view of a rotary joint in accordance with an exemplary embodiment of the invention

FIG. 1 illustrates a rotary joint connector 5 in accordance with an exemplary embodiment of the invention. The rotary joint 5 comprises a core 10 having electrically conductive and non-conductive surfaces arranged to provide multiple circuits. The core 10 is generally cylindrical, which facilitates smooth rotational movement about a longitudinal axis 11 passing through the center of the core 10. As shown, the core 10 may include a central longitudinal channel 12, which may, for example, provide a convenient path for certain wires 75 (FIG. 4) extending from a first electrical device (not shown) to pass internally through the rotary joint 5, so that some wires 75 can be attached at an end of the rotary joint 5 proximal the electrical device while other wires 75 can be attached at an end of the rotary joint 5 distal the electrical device.

In some cases, rotation of the rotary joint 5 may advantageously be accomplished during operation by turning an axle (not shown) that is substantially coincidental with the longitudinal axis 11 and extending into and/or through the central channel 12. Thus, any central channel 12 in the core 10 may be sized to receive the axle in addition to, or in lieu of, wires. Alternatively, as shown in FIG. 2, the core 10 may have a bearing support portion 30 at either or both ends to support one or more sets of bearings by which rotational movement may be imparted and which may be used in combination with or in lieu of the axle.

Returning to FIG. 1, a plurality of circumferential rings or grooved surfaces 16 are machined and/or molded into the core 10. In this manner, each circumferential groove 16 can individually receive and contact one or more contacts 130 from a stator 110 (FIG. 9), and thus complete an electric circuit. At least a portion of at least one groove 16 is electrically conductive, which may be achieved by having a groove 16 made of a suitably conductive material or by providing an electrically conductive coating over a non-conductive material, such as a plateable resin. The electrically conductive material typically forms a complete ring around the core 10 coextensive with the groove 16 so that as the rotary joint 5 rotates about its axis in either a clockwise or counterclockwise direction, electrical contact is preferably maintained with the stator contacts at all times to avoid undesirable interruption in the flow of electricity through the circuit. The grooves 16 are electrically isolated from one another by a partition region 15 intermediate each set of grooves constructed of an electrically insulating material having a non-plateable surface.

As will be discussed in more detail later with respect to FIG. 4, an electrically conductive path may extend from each circumferential groove 16 to a corresponding passageway 18 in the form of a tunnel passing internally through the rotary joint 5 that creates a continuous internal surface of the core 10. Like the groove 16, the passageway 18 is also electrically conductive and creates a trace that provides at least a portion of the conductive path from the groove 16 to an external connection point 14. As shown in FIG. 1, the external connection point is a wire trough 14, which may also be electrically conductive and serve as a solder pad for an individual wire to be attached to the particular passageway 18 emerging at that wire trough 14. Unless constructed to be part of the same circuit for some reason, each passageway 18 is electrically isolated from all other passageways 18 in the rotary joint 5, the passageways being substantially parallel to the longitudinal axis 11.

Figure 2:
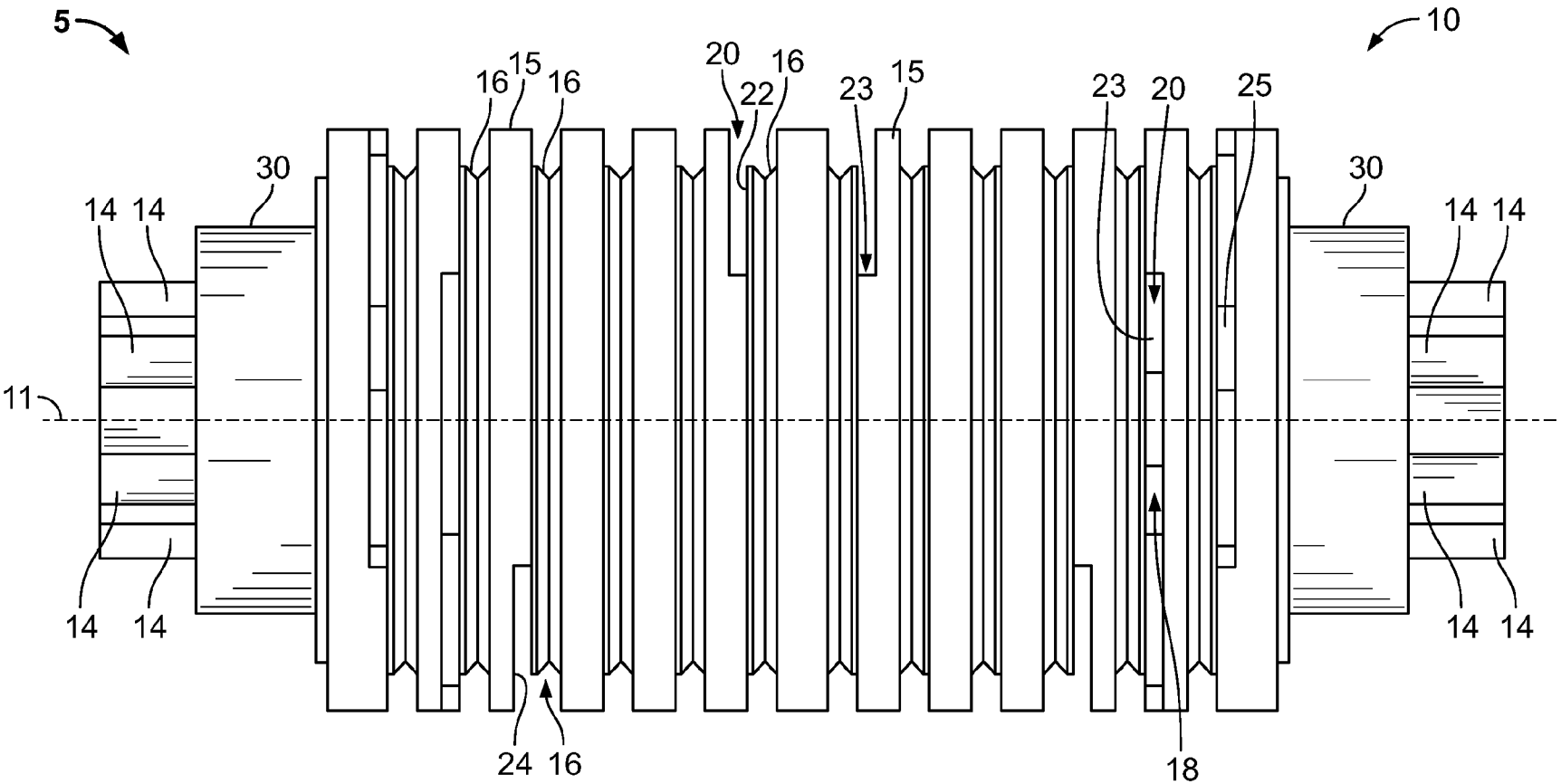
FIG. 2 illustrates a side view of a rotary joint in accordance with an exemplary embodiment of the invention.

As better seen in FIG. 2, the grooves 16 are integral the core 10 and may be slightly recessed from the outer diameter of the core 10 defined by the partition region 15. The grooves 16 may be concave, such as the illustrated v-shaped grooves 16. This may enhance the retention of contacts protruding into the groove 16 during operation, and thus reduce the possibility of interruption in electrical communication, such as may result from contacts slipping within the grooves 16, particularly when the rotary joint 5 is turning. The rotary joint 5 has a sufficient number of grooves 16 to correspond to the number of circuits that the rotary joint 5 is being used to connect. As illustrated in FIG. 2, the rotary joint 5 has twelve circumferential grooves 16 to correspond to twelve circuits, although as few as a single circuit needs to be completed. By adding additional grooves, as many as twenty four, forty eight or a higher number of circuits are possible, provided each circuit remains electrically isolated from other circuits. Typically, the partition 15 spaces the grooves 16 at least about 0.5 mm apart to achieve a desired resistance, which may also depend on the distance, if any, the grooves are recessed from the periphery of the core 10. In one exemplary embodiment, the partition 15 spaces the grooves 16 far enough apart to provide at least about 500 MΩ of resistance between adjacent circuits at 250 VDC.

According to one embodiment of the invention, a cross-cut 20 protrudes into the core 10 adjacent at least one groove 16. The depth of the cross-cut 20 into the core 10 generally ranges from about one quarter to about three quarters of the core's radius and more typically is about one half the core's radius. If multiple cross-cuts are included as discussed below, the depths may vary from groove to groove, but preferably are of the same depth. The cross-cut 20 typically extends perpendicular to the longitudinal axis 11 entirely across the core 10. That is, the cross-cut 20 typically forms a chord across the core 10 when viewed in cross-section.

Figure 5:
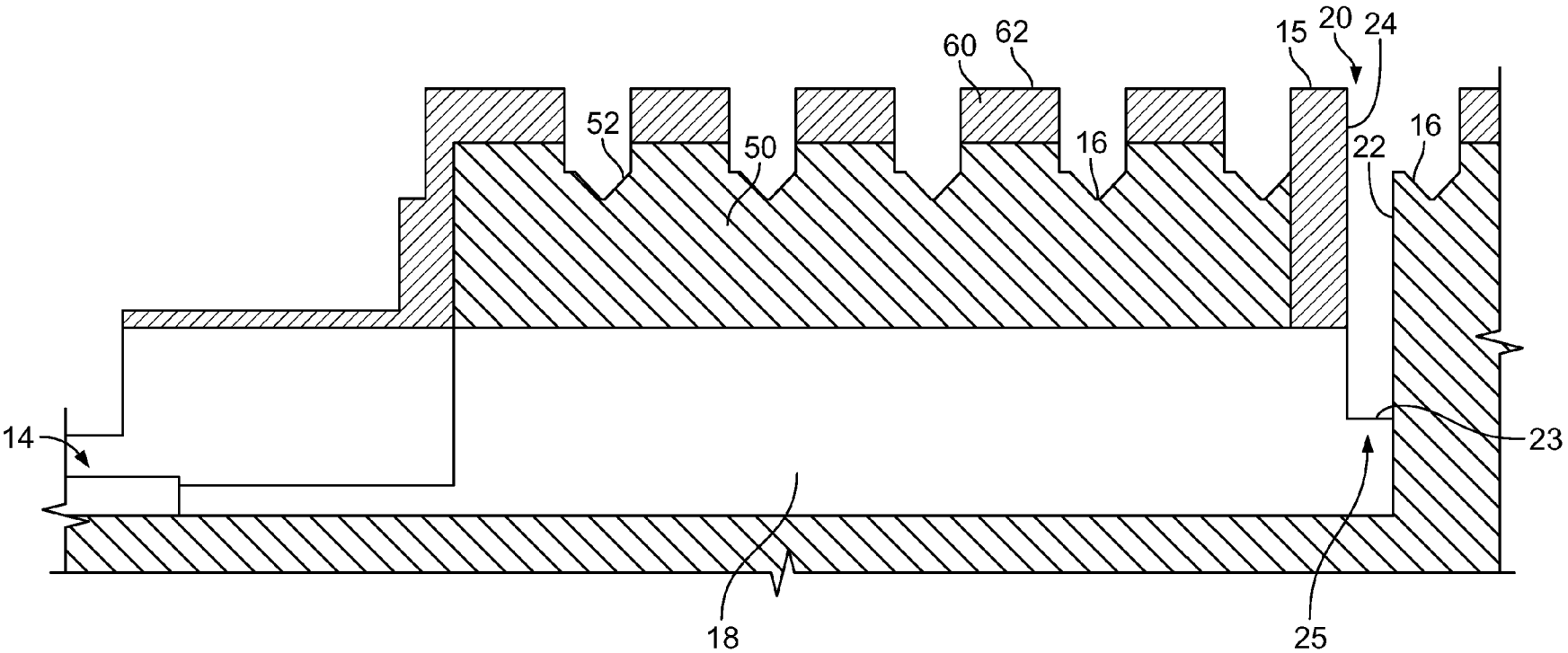
FIG. 5 illustrates an enlarged cross-sectional view of FIG. 4.

As seen better in the enlarged cross sectional view of FIG. 5, the cross-cut 20 typically removes a portion of the partition 15 at the partition 15/groove 16 interface and is defined by at least three surfaces, including a first wall 22 having a radially oriented surface adjacent the groove 16, a second radial wall 24 opposite the first wall having a surface adjacent the partition 15, and a floor 23 connecting the first and second walls 22, 24. At least a portion of the first wall 22 and typically a portion of the floor 23 are electrically conductive to provide a continuous electrical path between the groove 16 and the internal passageway 18, for example, via an aperture 25 in the floor 23 of the cross-cut 20.

Successive cross-cuts 20 may be present adjacent other grooves 16 and oriented at some angle to the others, thereby creating a rotating pattern of cross-cuts 20 in the core 10. Typically, the cross-cuts 20 are oriented so as to be equally spaced about the circumference of the core 10 according to the formula 360°/n, where n equals the number of circuits. For example, if two circuits are used, the cross-cuts 20 would ordinarily be oriented at 180° from each other, while if three circuits are used, they would ordinarily be oriented at 120°, etc.

The internal passageway 18 extends through the core 10 from the wire trough 14 to connect to a corresponding cross-cut 20. The passageway is generally straight and substantially parallel with the core's longitudinal axis 11 for ease of manufacture, although more complicated internal geometries are possible. The connection between the passageway 18 and its corresponding cross-cut 20 may be achieved by passing into that cross-cut 20 through the second wall 24, or more preferably via the aperture 25 in the floor 23 of the cross-cut 20.

Figure 3:
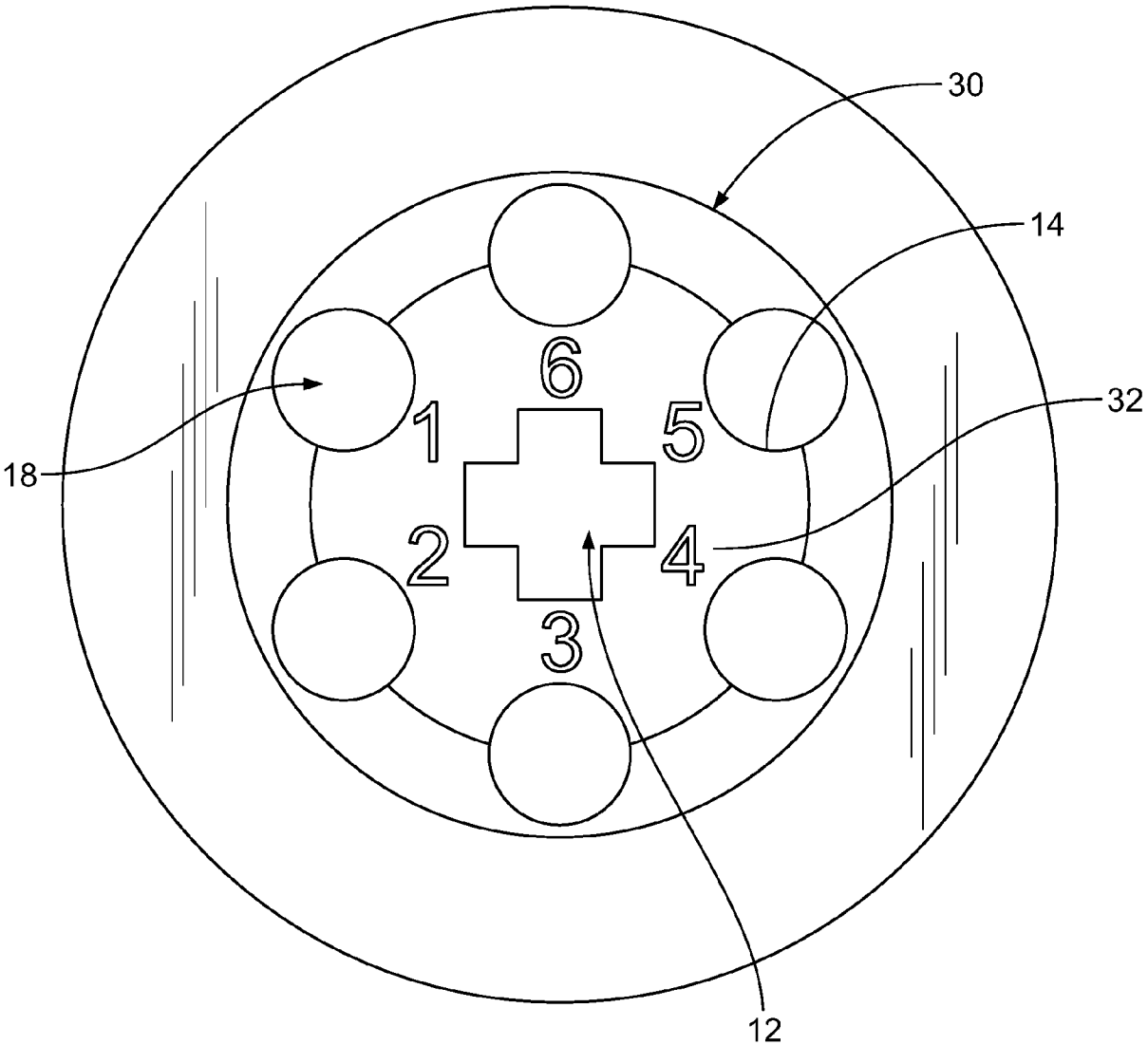
FIG. 3 illustrates a front view of a rotary joint in accordance with an exemplary embodiment of the invention.

Like the cross-cuts 20, the passageways 18 are also typically oriented with respect to other passageways in such a manner that one passageway 18 does not intersect any other passageway 18 or through any non-corresponding cross-cut 20. This maintains electrical isolation of the conductive path associated with a particular passageway from other circuits of the rotary joint 5. As seen in FIG. 3, six passageways 18 are oriented at 60° with respect to one another, which represents an equal angular spacing for each of six circuits. It may be desirable to provide indicia 32 on the rotary joint 5, as also shown in FIG. 3, to assist a user in attaching an appropriate wire to the appropriate wire trough 14 to ensure proper circuit operation.

Figure 4:
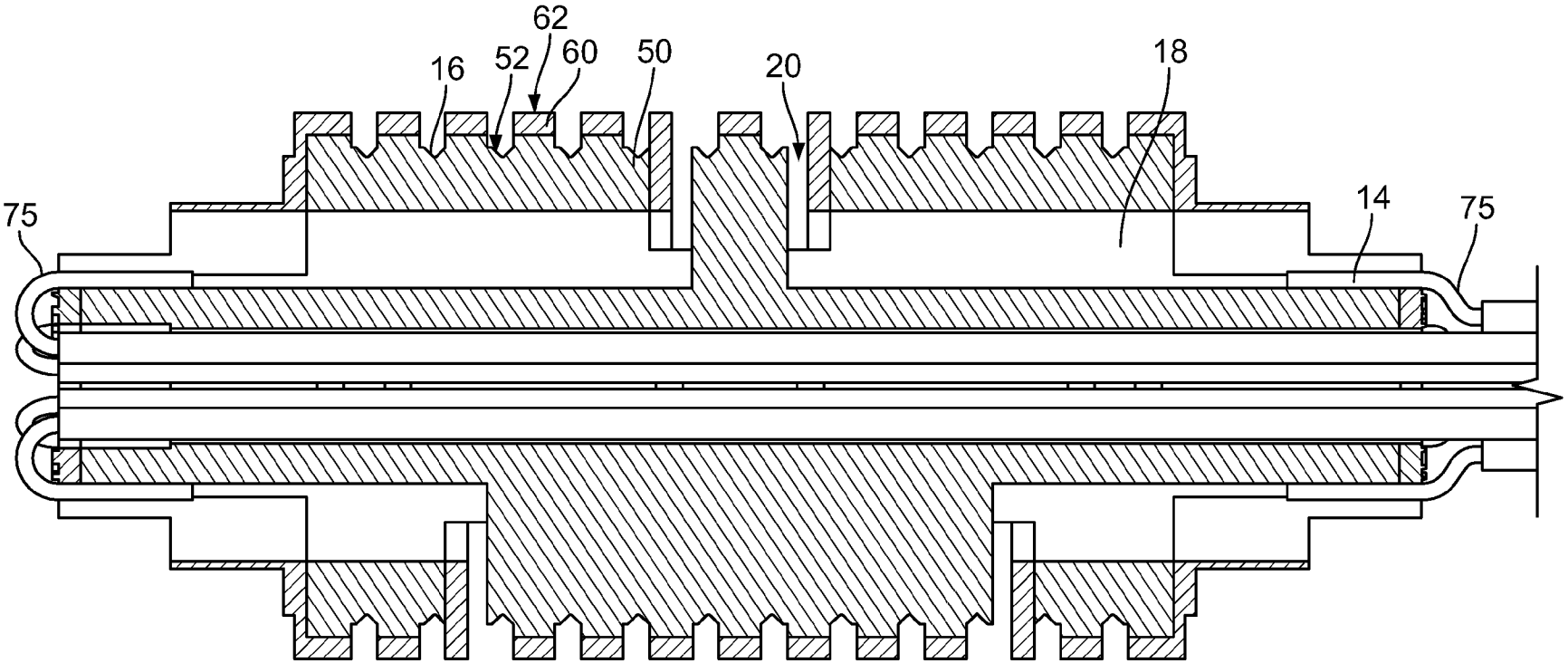
FIG. 4 illustrates a cross-sectional view of a rotary joint in accordance with an exemplary embodiment of the invention.

It will be appreciated that, as best seen in FIG. 4, the rotary joint 5 may have wire troughs 14 on both ends of the core 10. Thus, while some circuits may terminate at a distal end of the rotary joint 5 others may terminate at a proximal end, doubling the number of circuits of the rotary joint 5 if the corresponding number of conductive pathways are also provided. In this case, because two different circuits may terminate at opposite ends of the rotary joint 5, it may be possible to have two separate circuits at the same orientation, but with the conductive paths extending toward opposite ends of the core 10, thus maintaining electrical isolation of the paths. As also shown in FIG. 4, the core 10 may be substantially symmetrical from a midpoint toward its respective ends.

As described above, the rotary joint 5 has both electrically conductive and non-conductive surfaces. Preferably, this is achieved by manufacturing the core 10 from a combination of plateable and non-plateable resins. In this manner, surfaces that define the electrically conductive path may be formed with a plateable resin so that an electrically conductive material can be coated to the plateable surface to create the electrically conductive surface of the rotary joint 5. Conversely, the remaining surfaces, i.e., generally all surfaces which are not part of a conductive path, are formed from a non-conductive, non-plateable resin. Thus, surfaces of these materials do not become coated with an electrically conductive material during plating operations and serve to electrically isolate electrical conductive paths from one another to permit multiple circuits in the rotary joint 5. Suitable resins for use with the exemplary embodiments of the present invention include any wholly aromatic polyesters that fall into the category generally referred to as liquid crystal polymers (LCPs). Other suitable resins include ABS, polycarbonate, polysulfone, polyethersulfone, syndiotactic polystyrene and polyphthalamide, by way of example only.

The plateable resins for use with exemplary embodiments of the invention can be any resin that can be plated with a suitably continuous layer of electrically conductive material, typically a metal, to provide a usable electrically conductive path. More preferably, the resins are electrically non-conductive but are plateable using electroless plating techniques as described in more detail below, thus providing an insulative substrate beneath the conductive layer that further serves to maintain electrical isolation between conductive paths.

Plateable resins are commercially available and may be produced using processing techniques that involve adding a catalyzing component such as a silicate filler and/or certain metals dissolved or dispersed in a nonplateable resin. One such technique is described in more detail in U.S. Pat. No. 5,338,567, the entirety of which is hereby incorporated by reference.

The non-conductive surfaces may be formed from any non-plateable material, and is typically of the same family as the plateable resin. That is, for example, where the plateable resin is a liquid crystal polymer, the non-plateable resin is also generally selected to be a liquid crystal polymer. In some cases, the non-plateable resin may be the same base polymer as the plateable resin but which has no additives nor undergone any subsequent processing to make it plateable.

According to one embodiment of the invention, the plateable resin is a plateable LCP resin, such as Zenite® ZE55801 NC010, available from the DuPont Company of Wilmingtone, Del. or CCP 34-94096 available from the RTP Company of Winona, Minn., by way of example only, and the non-plateable resin is a non-plateable LCP resin, such as Zenite® 5130L, for example, also available from DuPont.

Because the core 10 may be formed by injection molding, the plateable and non-plateable resins are generally selected to have compatible melting ranges and molding ranges, as a well as comparable heat deflection temperatures. The melting ranges of the plateable and non-plateable resins may be within about 20° C. of each other. Likewise, the molding ranges of the plateable and non-plateable resins may also be within about 20° C. of each other.

According to one embodiment of the invention, a two-shot molding process is used in which the cylindrical core 10 is initially formed from plateable resin 50, followed by overmolding a shell of non-plateable resin 60 to at least a portion of the external surface of the core 10. The non-plateable resin shell is typically about 0.1 mm or greater in thickness, and more typically is at least about 0.5 mm thick. It will be appreciated, however, that the non-plateable resin may be of any thickness, provided that it sufficiently covers the plateable resin to prevent plating on corresponding surfaces intended to maintain electrical isolation between circuits.

The resulting molded component forms the basic cylindrical geometry of the core 10, and may even be a solid cylinder of plateable resin 50 entirely covered by a shell of non-plateable resin. The final component geometry, such as the internal passageways 18 and any wire troughs 14 may be subsequently bored or otherwise machined into the solid cylinder, breaking through the non-plateable shell 60 to expose underlying plateable surfaces 52. Likewise, the circumferential grooves 16 and the cross-cuts 20 may be machined into the rotary joint 5 by cutting through the outer shell of non-plateable resin 60 overmolded on the plateable resin 50 to expose plateable surfaces 52 of the plateable resin 50.

According to another embodiment, subsequent machining techniques may be reduced or avoided entirely by molding the core 10 into its final geometry in two separate molding steps. In the first molding step, an intermediate core is molded using plateable resin 50 so that the grooves 16, cross-cuts 20 and passageways 18 are all present. In a second molding step, a second mold masks the surfaces 52 of the intermediate core that will remain exposed for subsequent plating. The non-plateable resin 60 is injected to cover the unmasked surfaces of the intermediate core that will not be plated to a desired thickness as already described.

Alternatively, a combination of molding and machining the geometrical features and exposing surfaces of plateable resin at appropriate locations may be used. Molding temperatures generally range from about 270° C. to about 450° C. In embodiments in which the final geometry of the plateable resin is molded directly, with non-plateable resin applied only to unmasked portions, the core 10 is preferably cooled rapidly to maintain dimensional stability in the core's discrete geometrical features.

Once the core 10 has been formed to have plateable and non-plateable resin surfaces 52, 62 in the desired geometry, the core 10 then undergoes a plating process to provide a rotary joint 5 of unitary structure having electrically conductive and non-conductive surfaces. Plating is used to plate the exposed plateable resin surfaces 52 with one or more layers of a conductive material typically a metal, such as tin, copper, nickel, gold, silver, platinum, aluminum, palladium, alloys thereof and combinations thereof, by way of example only.

Figure 6:
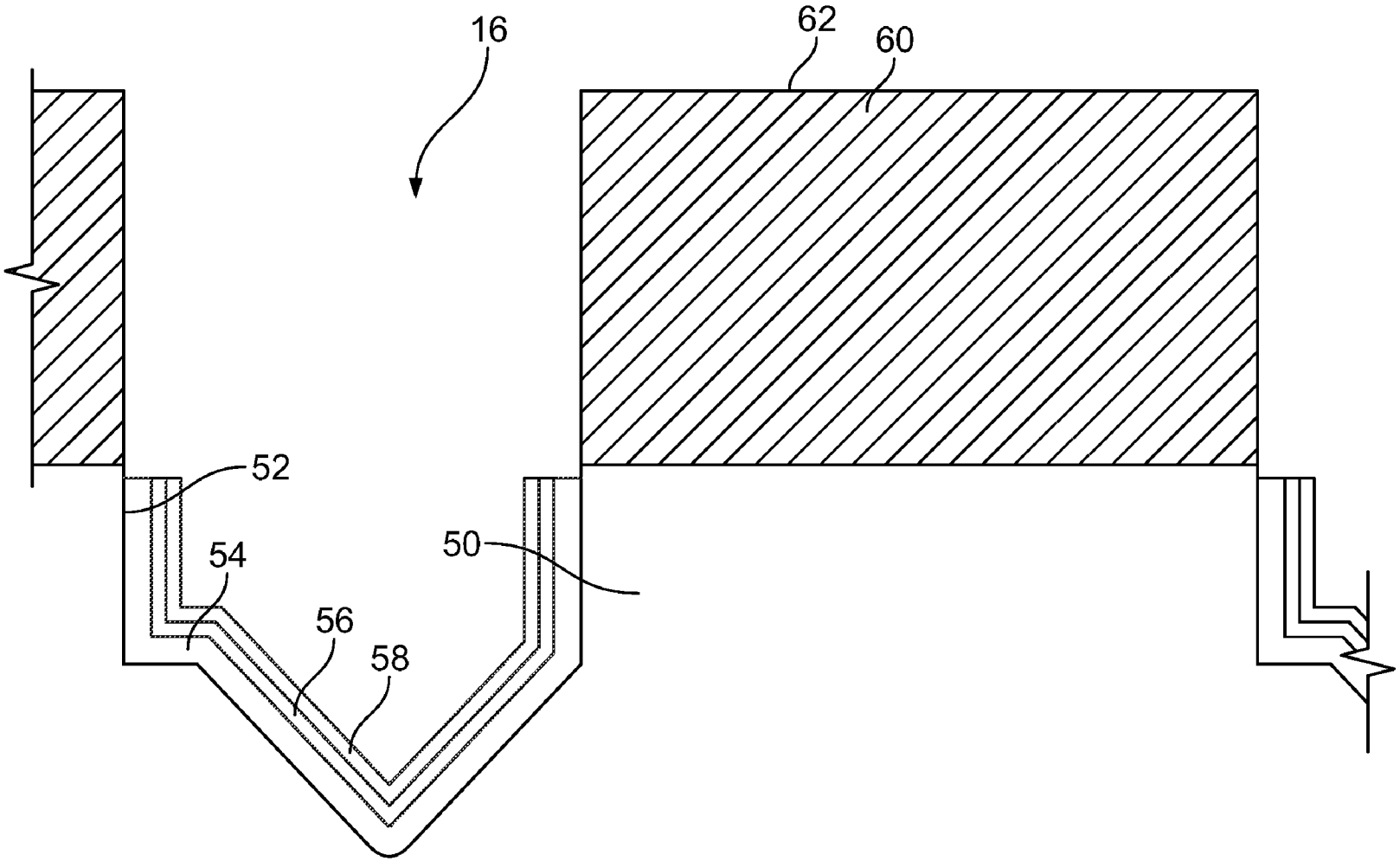
FIG. 6 illustrates a further enlarged cross-sectional view of FIG. 5.

According to one embodiment of the invention, an electroless plating bath is used to plate the exposed surfaces of plateable resin with three separate conductive layers (FIG. 6). As will be appreciated by those of ordinary skill in the art, electroless plating techniques generally involve a chemical reduction process that uses catalytic reduction of metal ions in an aqueous solution containing a chemical reducing agent resulting in subsequent deposition of that metal on the surface of a substrate placed in the solution and which does not require the use of electrical energy. It will be appreciated, however, that where multiple layers of electrically conductive material are used, once the first conductive layered is applied to the non-plateable resin by electroless plating, it may be possible to instead use electroplating for subsequent conductive layers.

The overall thickness of the conductive material may depend on the number and composition of the layers to be applied; generally about 10 to about 30 microns is sufficient. In accordance with an exemplary tri-layer embodiment shown in FIG. 6, a first layer of metal 54, such as copper, typically about 10 to 20 microns thick is applied to the plateable surfaces 52, such as those of the groove 16 shown in FIG. 6. A second layer of metal 56, such as a layer of nickel, may be applied to a thickness of about 1 to 10 microns overlying the first layer 54. A third layer of metal 58, such as gold, typically about 0.1 to about 1 micron thick, overlies the second layer 56. It will be appreciated that the materials, number, and thicknesses of the conductive layers shown and described with respect to FIG. 6 are exemplary only and may vary, for example, depending on the electrical properties desired to be achieved by the circuits of the rotary joint, such as the desired amperage and/or voltage per circuit.

According to yet another embodiment of the invention, the rotary joint 5 may be constructed by a single shot molding of the core 10 to its finally geometry using a plateable resin involving lithography techniques. After molding, the core 10 is submerged in an electroless plating bath to completely coat all surfaces of the core 10 with copper or another electrically conductive material. Following the plating, a lithographic process is used in which a resist is painted over those plated surfaces of the core 10 that will form the conductive surfaces of the finished rotary joint 5. The core 10 is then placed in an etching tank which removes the copper from those surfaces of the core 10 to which the resist was not applied, re-exposing the underlying resin. Finally, the resist is removed from the core 10 to reveal the conductive surfaces of the core 10, from which the copper was protected during etching by the resist, to yield the final rotary joint 5.

Figure 7:
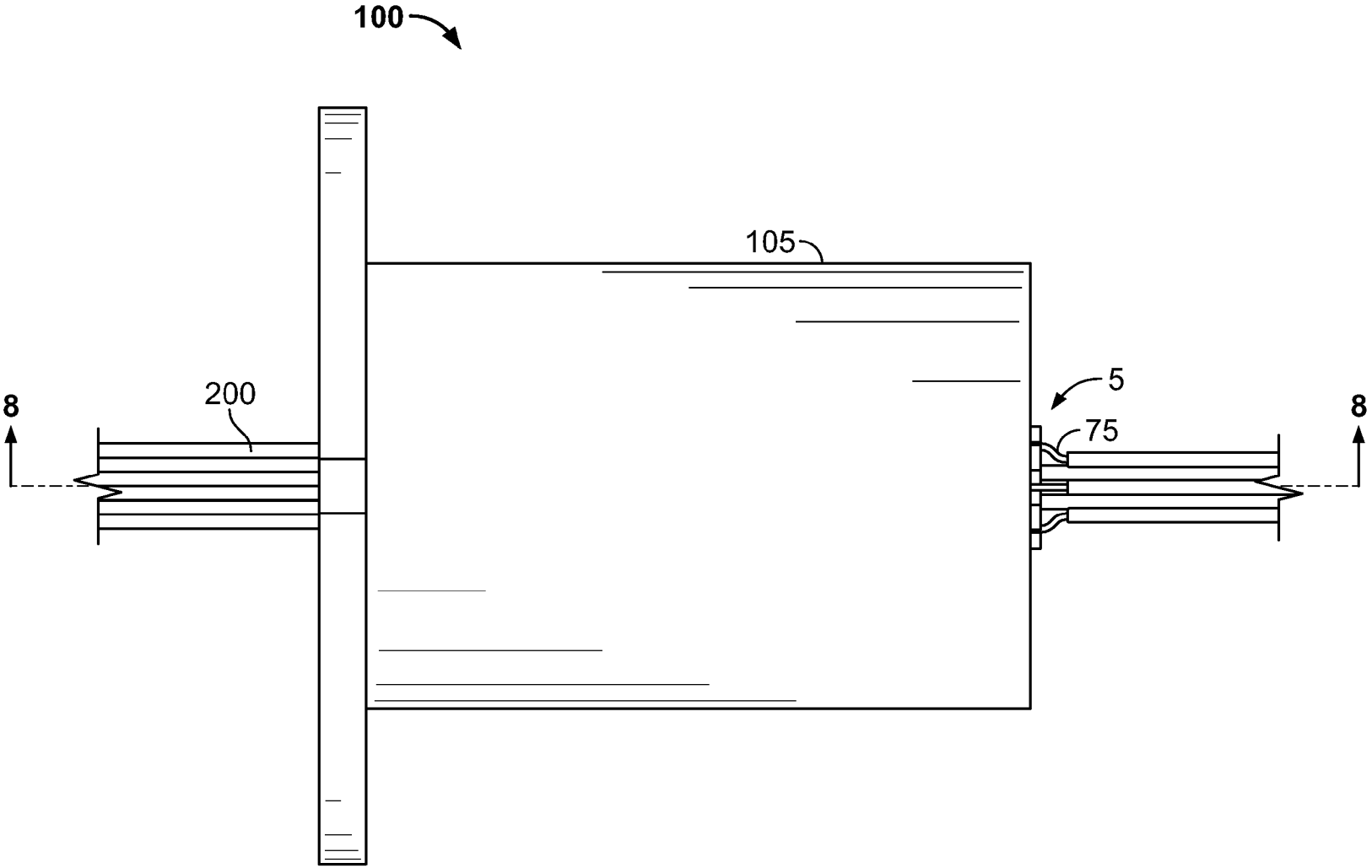
FIG. 7 illustrates an assembly in accordance with an exemplary embodiment of the invention.

FIG. 7 illustrates an assembly 100 according to an exemplary embodiment of the invention in which a rotary joint 5, to which wires 75 from at least one first electrical device are attached, is in electronic communication to carry electric power and/or control signals through conductive paths in the rotary joint 5 as previously described to complete a circuit with at least one second electrical devices via wires 200.

Figure 8:
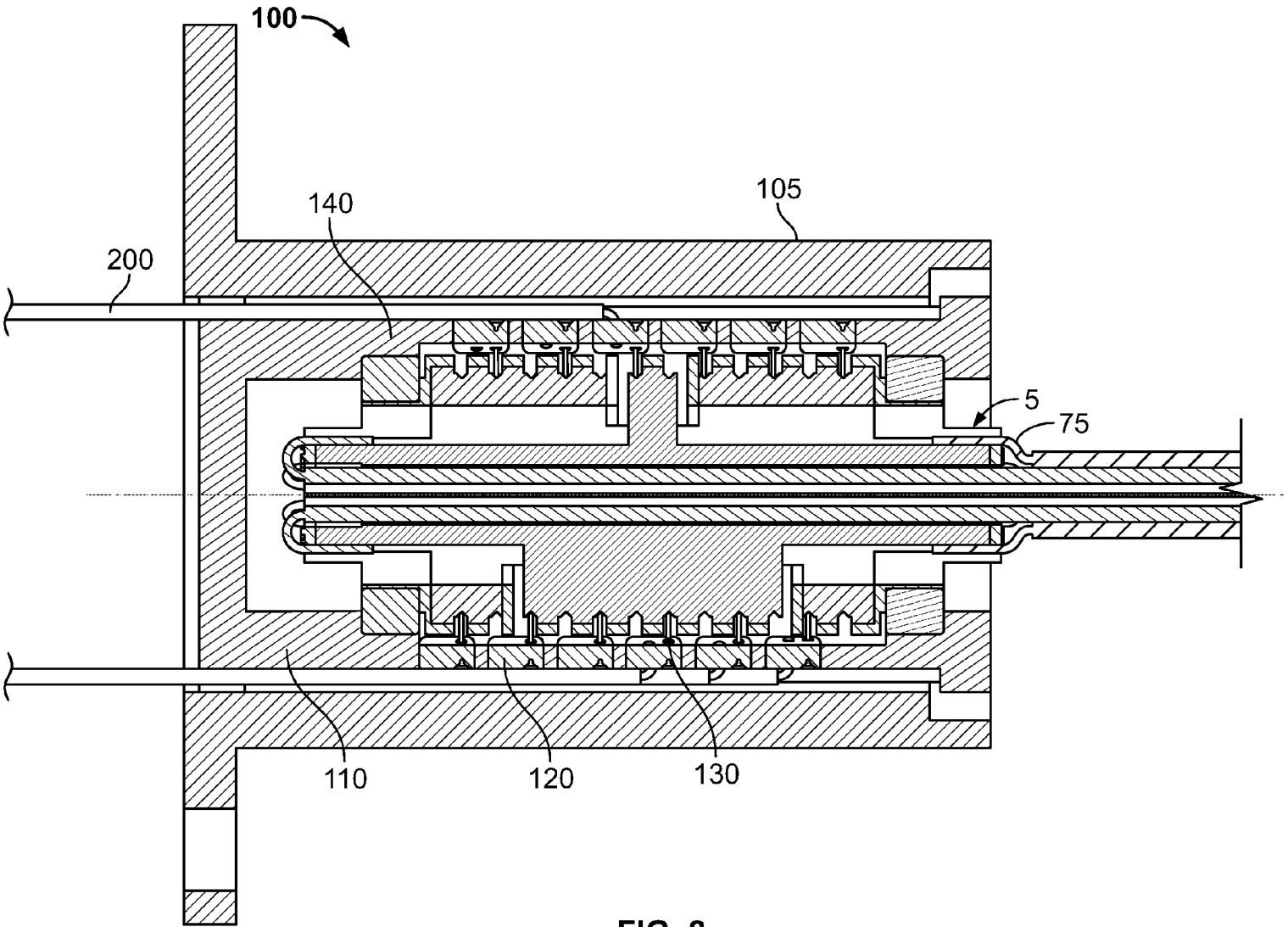
FIG. 8 illustrates a cross-sectional view of the assembly of FIG. 7.

As better seen in the cross sectional view shown in FIG. 8, the assembly 100 includes a stator housing 105 that at least partially surrounds a stator 110. The stator 110 remains stationary with respect to the stator housing 105, while the rotary joint 5 is positioned at least partially within the stator 110 and can be pivoted or freely rotated about a longitudinal axis with respect to the stator 110. The wires 200 of the second electrical device are attached to the stator 110 at attachment plates 120 and are in electrical communication with the rotary joint 5 via stator contacts 130, such as brush wires, which extend into the grooves 16 of the rotary joint 5. The stator attachment plate 120 serves as an electrically conductive bridge between the stator contacts 130 and the wires 200 leading to the second electrical device. Because each groove 16 of the rotary joint 5 is generally associated with a single circuit, each of the wires 200 from the second electrical device is associated with a different set of stator contacts 130, and consequently a different groove 16 and different circuit of the rotary joint 5.

Figure 9:
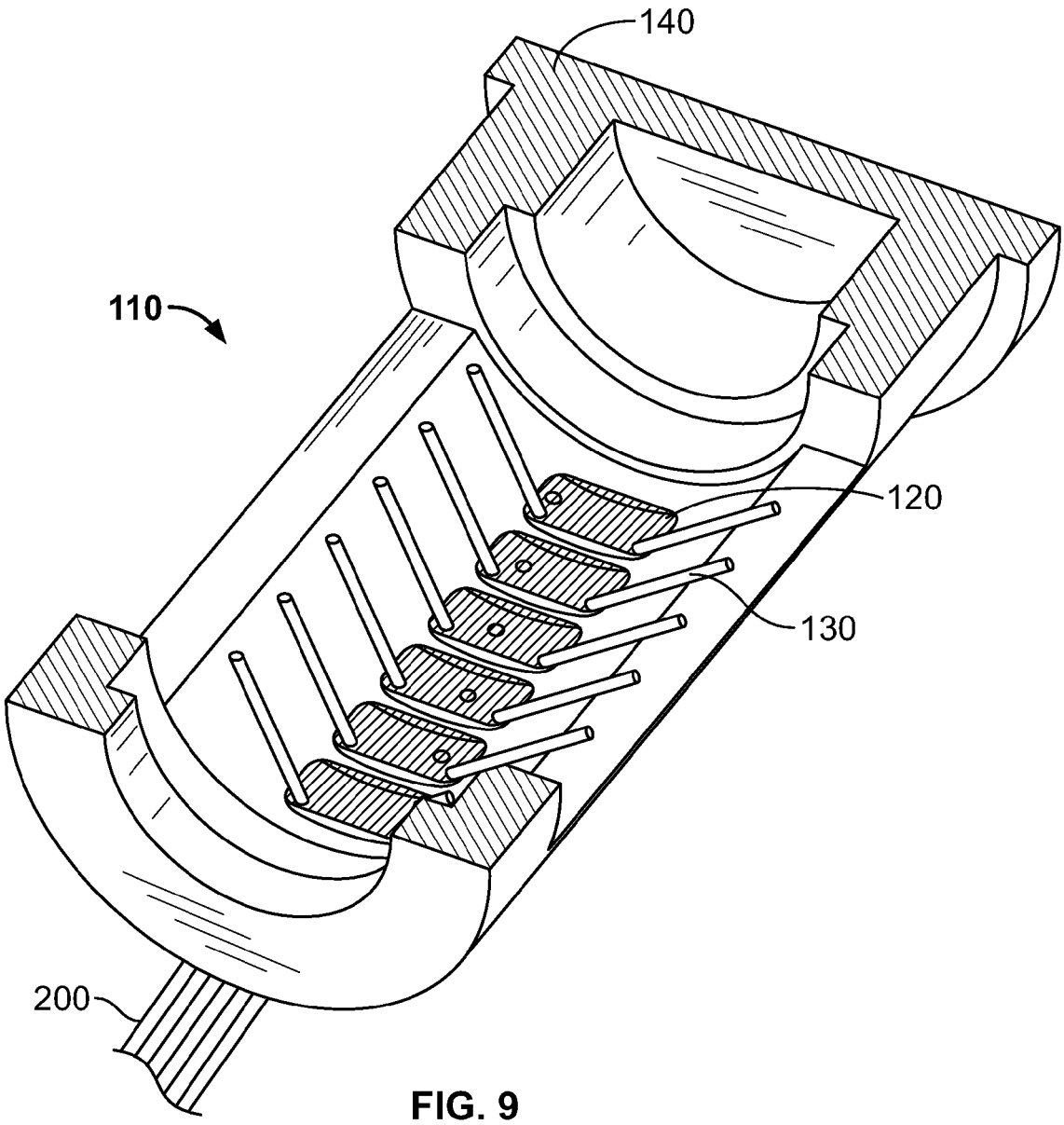
FIG. 9 illustrates an isometric view of a stator portion of the assembly of FIG. 7.

The stator 110 may include a stator core 140 having two equal halves, one half of which is illustrated in FIG. 9. For space considerations, the total number of stator contacts 130 and corresponding attachment plates 120 may be divided between the two halves of the stator 110. Preferably, each attachment plate 120 includes two stator contacts 130 positioned to engage its respective groove 16 at two different places, which may assist in maintaining continuity of the electrical communication during operation, particularly when the rotary joint 5 is turning with respect to the stator 110.

Conversely, by splitting the stator 110 into two halves, it may be possible to use each half as a separate tools to connect the first and second electrical devices directly by orienting the two stator halves opposite one another and disposing the stator contacts 130 for each stator half in the same groove 16 of the rotary joint 5.

The stator attachment plate 120 may advantageously be a plateable resin with an overlying metallic layer as described above with respect to the rotary joint 5. Conversely, the stator core 140 may be a non-plateable resin, electrically isolating attachment plates 120 and contacts 130 of different circuits from one another.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A rotary joint comprising:

a cylindrical core having an external surface including at least two circumferentially oriented groove regions integral the core and an integral partition region intermediate the groove regions, wherein at least one groove region includes an electrically conductive surface portion in electrical communication with an electrically conductive hollow passageway passing internally through the cylindrical core from the at least one groove region to a connection point external the cylindrical core, wherein at least a portion of the surface of the partition region is electrically insulating and wherein the electrically conductive hollow passageway further comprises an electrically conductive internal surface of the cylindrical core.

2. The rotary joint of claim 1, wherein the electrically conductive surface portion of the at least one groove region is electrically isolated from every other groove region.

3. The rotary joint of claim 1, wherein the external connection point comprises a wire trough at an end of the cylindrical core.

4. The rotary joint of claim 1, wherein the electrically conductive surface portion of the at least one groove region comprises an electrically conductive material overlying a plateable resin.

5. The rotary joint of claim 1, wherein the electrically conductive surface portion of the at least one groove region comprises a layer of metal overlying a plateable liquid crystal polymer resin.

6. The rotary joint of claim 1, wherein the electrically insulating surface portion of the partition region comprises a non-plateable polymeric resin.

7. The rotary joint of claim 1, wherein the partition region of the cylindrical core comprises a non-plateable resin overlying a plateable resin.

8. The rotary joint of claim 1, wherein the cylindrical core comprises at least one resin selected from the group consisting of polyesters, ABS, polycarbonate, polysulfone, polyethersulfone, syndiotactic polystyrene and polyphthalamide.

9. The rotary joint of claim 1, wherein the cylindrical core comprises at least one liquid crystal polymer.

10. The rotary joint of claim 1 wherein the cylindrical core comprises a cross-cut adjacent the at least one groove region, wherein the cross-cut defines a first wall adjacent the at least one circumferentially-oriented groove region, a second wall opposite the first wall and floor connecting the first wall to the second wall.

11. The rotary joint of claim 10, wherein the cross-cut has a depth in the range of about one quarter to about three quarters of a radius of the cylindrical core.

12. The rotary joint of claim 10, wherein at least a portion of the first wall is electrically conductive.

13. The rotary joint of claim 10, wherein a plurality of conductive groove regions are each independently a portion of an electrically conductive path passing from the groove region to a connection point external the cylindrical core through an internal passageway of the cylindrical core, wherein the floor defined by at least one cross-cut contains an aperture for completing the conductive path between the passageway and the groove region.

14. The rotary joint of claim 13, wherein the cross-cut and internal passageway for each electrically conductive path is oriented with respect to other cross-cuts and internal passageways such that each electrically conductive path is electrically isolated from every other electrically conductive path.

15. The rotary joint of claim 1 comprising a longitudinal channel passing through the center of the cylindrical core.

16. The rotary joint of claim 1, wherein at least a portion of the at least one groove region is concave.

17. A rotary joint comprising:

a unitary cylindrical core including an exterior surface having at least two circumferentially-oriented grooves and having a partition region interposed between the at least two circumferentially-oriented grooves, wherein the grooved surfaces defined respectively by the at least two circumferentially-oriented grooves each include an electrically conductive portion, and wherein at least a portion of the surface of the partition region is electrically insulating;

the unitary cylindrical core further including at least two internal conductive hollow passageways that correspond respectively to each of the at least two circumferentially-oriented grooves; and the unitary cylindrical core further including at least two external connection points that correspond respectively to each of the at least two internal conductive passageways, wherein each of the at least two internal conductive hollow passageway comprises an electrically conductive internal surface to provide conductive communication between the conductive surface of the corresponding circumferentially-oriented groove and the corresponding external connection point.

* * * * *